United States Patent [19]

Seyler et al.

[11] 3,970,986

[45] July 20, 1976

[54] THICK FILM ROTARY SWITCH

[75] Inventors: Gerard Seyler, Des Plaines; Kenneth J. Roback, Niles, both of Ill.

[73] Assignee: Motorola, Inc., Schaumburg, Ill.

[22] Filed: Jan. 30, 1975

[21] Appl. No.: 545,456

[52] U.S. Cl. ..... 338/171; 200/11 G; 338/137; 338/162; 338/167; 338/184

[51] Int. Cl.[2] ..... H01C 10/00; H01C 10/06

[58] Field of Search ..... 338/160, 162, 171, 184, 338/185, 190, 137, 167; 200/11 EA, 11 G, 291

[56] References Cited

UNITED STATES PATENTS 3,200,208 8/1965 Mastney ..... 200/11 G X

*Primary Examiner*—C. L. Albritton

*Attorney, Agent, or Firm*—James W. Gillman; Donald J. Lisa

[57] ABSTRACT

A housing having a central bore therein receives a rotor rotatably mounted therein and secured thereto having an enlarged round base portion. A thrust plate is mounted for limited axial reciprocation within a recessed opening in the housing concentric with the rotor and adjacent the rotor base. The rotor base and thrust plate are formed with cooperating detents and notches to provide indexing means for rotationally positioning the rotor. The internal recess of the housing and the exterior of the thrust plate are configured with matching shapes to prevent rotational movement therebetween, rotation of the rotor moving the detents from one pair of diametrically opposed notches to the next adjacent pair of said notches, while the thrust plate reciprocates against the action of a biasing means. The lower end of the rotor carries a contactor mounted for fixed rotation therewith and having a pair of downward extending arms. The lower end of the housing is closed with an end plate having a pair of outwardly extending output terminals. On the interior surface of the end plate are formed, by thick film technology, circuit elements made of conductive and resistive materials having portions arranged geometrically for contact with the contactor arms such that, dependent upon rotor position, selected ones or portions of the circuit elements having different predetermined resistive values are electrically coupled between the output terminals. Means are provided to limit rotor rotational position to a predetermined arc. The switch may be provided with internal sealing means to maintain the uncontaminated integrity of the switch and external sealing means for sealing by mounting the entire switch within another encapsulated electronic component.

18 Claims, 7 Drawing Figures

THICK FILM ROTARY SWITCH

BACKGROUND OF THE INVENTION

1. Field Of The Invention

The present invention relates to rotary switches and particularly to one which has one or more circuit elements made of resistive materials to provide an internal resistance formed integrally therewith which can be selectively electrically coupled between the output terminals in relation to a selected rotational position of the rotor.

2. Prior Art

The prior art includes numerous types of rotary switches having integrally mounted therein a large number of contacts arranged in circular outline and carried by an insulating wafer with a rotary arm adapted to engage the contacts singly or in pairs to selectively complete the electrical circuit between a plurality of output terminals indexed to the rotational position of the rotor. Normally such switches provide means for limiting the rotational movement of the rotor within a predetermined arc. In some cases the switches are completely enclosed in a housing and have an end plate formed as a printed circuit board, and are adapted for external mounting.

Normally, however, the switches are cumbersome, complex and expensive. Such switches do not provide for a simple efficient combination of moving elements which can index the rotor to a selected position, hold it there until it is forcibly moved to another position while simultaneously resisting wear, sealing out contaminants, making good contact and being inexpensive to manufacture. In addition, such switches normally simply make or break contact with the interior exposed contact surfaces of the the plate or printed circuit board, which surfaces are directly connected to the output terminals and do not provide for housing resistive or other circuit elements internally of the switch for selective coupling or decoupling in an internal electric or electronic circuit between the output terminals.

SUMMARY OF THE INVENTION

Accordingly, it is an object of the present invention to provide a rotary switch with one or more integral, internal resistances as an integral part thereof, one or more of the internal resistances being selected upon indexing the rotor to one of a plurality of positions by rotating the rotor such that the switch has an internal resistance which is continuously variable or selectively variable in increments between the output terminals.

It is a further object of the present invention to provide a rotary switch which is leakproof and adapted for use within an external solid state electrical component.

It is a further object of the present invention to provide a rotary switch in which the internal resistance is fixed to an internal surface of the switch through the use of conventional thick film technology.

It is a further object of the present invention to provide a rotary switch which is adapted for a variety of end uses derived from substituting different substrates carrying circuit elements thereon, including one or more integrated circuits, and providing a unique flexibility.

It is a further object of the present invention to provide a rotary switch comprising a unique assembly of fixed and movable parts which is efficient and durable and which is also inexpensive, reliable and easy to manufacture and assemble.

A further object is to provide improved detent means which will hold the rotor in the selected switch position until actuated and then index to the next position with a snap action.

Briefly, the electrical switch of the present invention has a housing having a central aperture therethrough and a shaped recessed opening at one end into which is mounted a thrust plate also having a central aperture therethrough, and a shaped exterior cross section. The thrust plate is mounted within the recessed opening of the housing for limited axial movement therein, the shaped recessed opening of the housing and the shaped exterior cross section of the thrust plate cooperating to prevent rotational movement of the thrust plate relative to the housing. A rotor is rotatably mounted within the housing having a shaft at one end extending outwardly of the switch through the central aperture of the housing and the thrust plate and is adapted for imparting rotational movement to the rotor. The rotor carries an enlarged base at one end. Indexing means is provided for selectively positioning the rotor in a predetermined position within the arc of rotation of the rotor. External means secures the shaft to the housing. Contact means secured to the base of the rotor for rotation therewith is electrically isolated therefrom. The housing is closed with an end plate secured to the recessed opening thereof having interior and exterior surfaces, and carrying electrical circuit elements mounted on the interior surface electrically isolated therefrom and terminating in a pair of output terminals extending outwardly of the housing. The electrical circuit elements are predeterminedly arranged in a geometric configuration having portions in alignment with the contact means for selectively being contacted by the contact means in relation to the selected rotational position of the rotor to complete the electrical circuit between the output terminals, the contacting means being of a continuous conductive material for shunting nonselected portions of the circuit elements whereby selected portions of the circuit elements are electrically connected between the output terminals. Means is provided for limiting rotational movement of the rotor to a predetermined arc includes lug means carried by the rotor and recessed means of a predetermined circumferential length relative to the longitudinal axis of the switch carried by the thrust plate having stop shoulders at the ends thereof, the lug means of the rotor being received and movable within the recessed means of the thrust plate and abutting the shoulders at the respective ends of the recesses to limit rotational movement of the rotor to the predetermined length of the recessed means.

DETAILED DESCRIPTION OF THE DRAWINGS

DETAILED DESCRIPTION OF THE PREFERRED EMBODIMENTS

Figure 2:
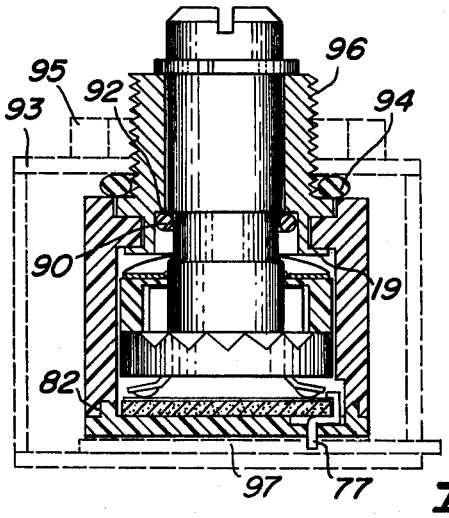
FIG. 2 is an elevation view of the rotary switch in partial section in solid lines and, in dotted lines showing its utilization within an external encapsulated electrical component. The section is made along the plane 2—2 of FIG. 3.
Figure 1:
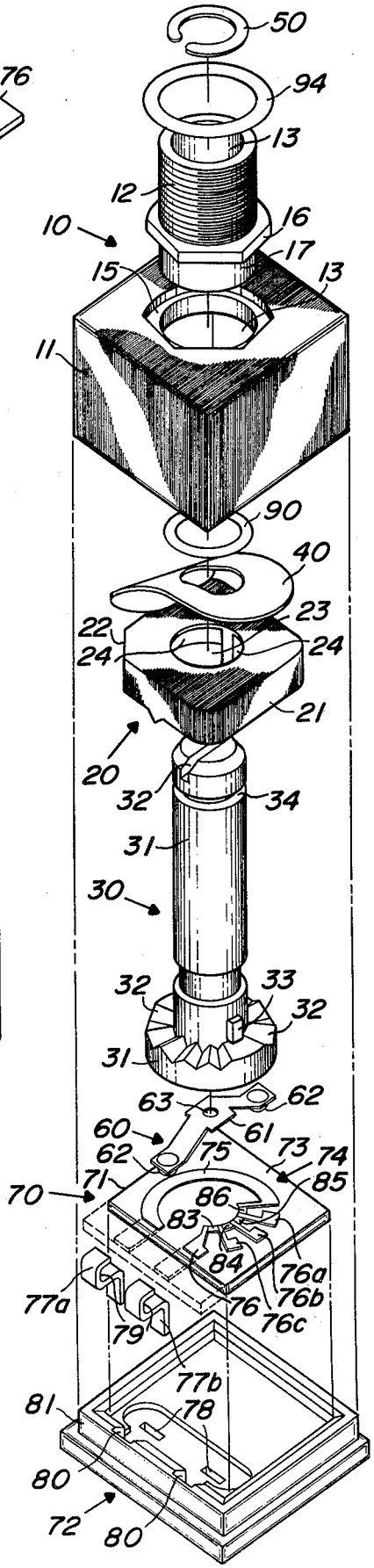
FIG. 1 is an exploded perspective of the rotary switch of the present invention showing the substrate with the circuit elements thereon in solid lines and, in dotted lines an alternative embodiment thereof.

Referring now specifically to the drawings wherein the same numbers are used to refer to similar parts used in the various embodiments, there is shown in FIG. 1 all the elements of a preferred embodiment. Housing 10 comprises a base portion 11 and a sleeve portion 12 each having a central aperture 13 therethrough. Base portion 11 is formed with a shaped recessed opening 14 (FIG. 6) at one end and a second shaped recessed opening 15 at the other end. Sleeve portion 12 is formed with a shaped flange portion 16 and a cylindrical extending portion 17 both adjacent one end. The flange portion 16 is received within the second recessed opening 15 of the base housing portion and are of matching shape to prevent rotation of the one relative to the other when the shaft is rotated. The cylindrical extending portion 17 is received within the central bore of the base housing portion 11 and is turned over (FIG. 2) to secure the sleeve and base housing together. The outwardly extending shaft of the rotor, to be described below, extends through the central aperture of both the base housing and sleeve. The base housing portion is preferably made of plastic and the sleeve is preferably made of brass or other like metal, or even of plastic, dependent on the particular application. The outside surface of the sleeve may be threaded for securing to an external support surface (FIG. 2).

Figure 5:
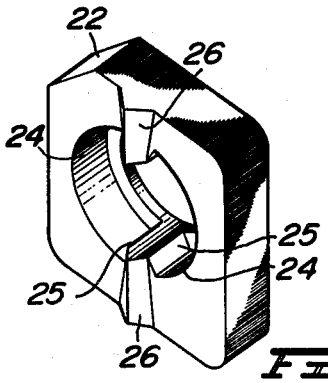
FIG. 5 is an oblique perspective of the thrust plate of the present invention.

A thrust plate 20 is preferably made of plastic and is formed with an exterior shaped surface 21 which matches the shaped recessed opening 14 of base housing portion 11, and as shown is square. One corner 22 of the thrust plate is flattened to match a corresponding flattened corner 18 of the base housing portion 11 for proper orientation of the parts during assembly. Thrust plate 20 is further formed with a central bore 23 a pair of oppositely disposed circular recesses 24 having a predetermined circumferential length relative to the longitudinal axis of the switch, each end of the recess means having a wall portion 25 (as best seen in FIG. 5) which forms a stop shoulder to be more fully described below. The thrust plate 20 is also provided with a pair of oppositely disposed detents 26 (as best seen in FIG. 5) extending toward the recessed open end 14 of base housing 11. Thrust plate 20 is mounted within the recessed opening 14 of base housing 11 for limited axial movement as more fully described below. The shaped recess opening 14 of base housing portion 11 and the shaped exterior cross section 21 of thrust plate 20 cooperate to prevent rotational movement of the thrust plate relative to the housing when the shaft is rotated.

FIG. 1 further shows a rotor 30 which is rotatably mounted within the housing and has a shaft 31 extending outwardly of the switch through the central aperture 23 of the thrust plate and the central aperture 13 of the housing 10 and is adapted as by slot 32 for imparting the rotational movement to the rotor. At the other end of shaft 30 is an enlarged based 31 formed with a plurality of oppositely disposed notches 32 facing the other recessed end 15 of base housing portion 11 for engagement by the detents 26 of the thrust plate 20. Accordingly, the detents 26 and notches 32 formed on the thrust plate and rotor base respectively comprise an indexing means for selectively positioning the rotor in one of a plurality of predetermined positions within the arc of rotation of the rotor. Wave washer 40 comprises a biasing means which is concentrically positioned over the shaft 31 between the inward ends 19 (FIG. 2) of the recessed opening 14 of housing 11 and the top surface of thrust plate 20. Wave washer 40 biases the thrust plate downwardly such that the detents 26 are forced into engagement with the notches 32. Rotational movement imparted to the shaft 30 moves the notches of the base 31 relative to the detents 26 of the thrust plate 20 to position the rotor in the selected position, the thrust plate reciprocating against the biasing means axially as the detents are forced out of one pair of notches into the next pair of adjacent notches. The base 31 is round.

Means is provided for limiting rotational movement of the rotor to a predetermined arc. To accomplish this end rotor 30 is formed with a pair of oppositely disposed lugs 33 extending upwardly and outwardly from the round base 31 diametrically opposed from the oppositely disposed plurality of notches 32. Lugs 33 are received within the recess openings 24 of the thrust plate. The lugs 33 abut the shoulder 25 at the respective ends of the recesses 24 to limit rotational movement of the rotor to the predetermined arc.

The end of shaft 31 is adapted as by slot 34 which receives retainer ring 50 for being secured to the housing 10 for rotational movement therein while holding the rotor thrust plate and biasing means in assembled relation.

Figure 4:
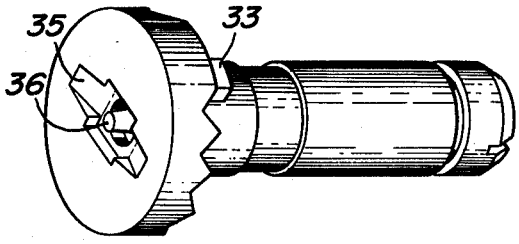
FIG. 4 is an oblique perspective of the rotor of the present invention.

Contact means 60 is secured to the base 31 of the rotor for fixed rotation therewith while being electrically isolated therefrom. The rotor 30 is preferrably made of plastic while contact means 60 is made of a continuous conductive material, such as spring copper alloys or steel, or the like. Contact means 60 is formed with a square shaped central portion having a central aperture 63 and also having two downwardly extending arm portions 62. The end of base 31 facing the recessed open end 14 of the housing has a similarly shaped recess 35 and post 36 which receives and positions the spring contact for fixed rotation therewith. (FIG. 4). When the arms 62 complete the circuit between the circuit elements mounted on end plate 70, as more fully described below, a short circuit is created therebetween thereby shunting non-selected circuit elements and coupling the selected portions of the circuit elements electrically between the output terminals.

The lower end of base housing portion 11 is closed by an end plate means 70 which is secured to the recessed open end of the housing 11 for closing the end thereof. The closure means includes an end plate substrate 71 and a cover 72. Substrate 71 is typically formed of an insulative material such as a ceramic or a plastic or the like. Mounted on the interior surface 73 of substrate 71 using well known thick film technology are electrical circuit elements shown generally as 74 in FIG. 1. These circuit elements are predeterminedly arranged in a geometric configuration on the surface 73 and have portions 75, 76, 76*a*, 76*b* and 76*c* in alignment with contact arms 62 for selectively being contacted by contact means 60 is relation to the selected rotational position of the rotor. The circuit elements 74 are electrically coupled to a pair of output terminals 77*a,b* which sealingly extend through and outwardly of the housing through openings 78 formed in the cover 72. Terminals 77*a,b* are formed with U-shaped channels 79 which slip over the side edge of the substrate 71 into electrical contact with portions 75, 76 of the electrical circuit elements for completing the electrical circuit therebetween. Cover 72 carries notches 80 and openings 78 which receive terminals 77*a,b*. Cover 72 is square and has a square extending portion 81 which is received frictionally within a similarly shaped recess 82 (FIG. 2) for sealingly closing the end of the switch.

As shown in FIG. 1 the electrical circuit elements include a first conductive material 75 which is connected to one output terminal 77*a*. Element 75 forms a continuous electrical path geometrically in alignment with the arc of rotation of one contact arm 62 and, when the switch is assembled, is in continuous electrical contact therewith. A second electrical path is formed between the other output terminal 77*b* and the other circuit elements 76, 76*a*, 76*b* and 76*c* which include elements made of a second material 83, 84, 85, 86. The second electrical path has portions 76, 76*a*, 76*b* and 76*c* geometrically aligned with the arc of rotation of the other contact arm 62 for contact therewith to complete the electrical circuit between the first continuous path and the second path. Elements 76, 76*a*, 76*b* and 76*c* comprise islands of the first conductive material electrically isolated from the first continuous path 75 and from each other. Circuit element 83 is coupled between island 76 and island 76*c*. Circuit element 84 is coupled between islands 76*b* and 76*c*. Circuit element 85 is coupled between islands 76*a* and 76*b*. Circuit element 86 is coupled between the first continuous path 75 and island 76*a*. Thus circuit elements 83, 84, 85 and 86 include a plurality of elements, a single element briding two adjacent ones of the islands. Each island couples together two adjacent circuit elements, the islands and elements together forming a continuous electrical circuit to the output terminal 77*b*. When the rotor is positioned in a predetermined position with detent 26 engaging a predetermined pair of notches 32, the rotor is indexed such that one contact arm 62 is engaged with the conductive material 75 and the second contact arm is engaged with one of the islands, 76*a*, for example, completing the electrical circuit from one output terminal 77*a* through the first electrical path 75 and first contact arm 62 to the other contact arm 62 and island 76*a*, thence through circuit means 85, island 76*b*, circuit means 84, island 76*c*, circuit means 83, island 76 and the other output terminal 77*b*. When the second contact arm 62 engages island 76*b*, for example, circuit elements 84 and 83 coupled by island 76*c* are coupled between the output terminals, etc. In one form of the invention, the elements 83, 84, 85 and 86 are all made of a resistive material having predetermined resistances. Alternatively, circuit elements 83, 84, 85 and 86 may comprise other types of circuit means such as capacitors, or integrated circuits of various types. Accordingly, the rotary switch of the present invention provides a wide flexibility in selectively coupling various circuit elements between the output terminals 77*a,b* in accordance with a predetermined index position of the rotor.

Figure 7:
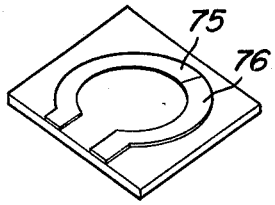
FIG. 7 is a perspective view of a still further embodiment of the substrate to form a potentiometer.

In FIG. 7 another alternative embodiment is shown in which the first continuous path 75 is of a conductive material and the second path 76 is also a continuous path made of resistive material. By eliminating the detents 26 and notches 32, it is seen that for any predetermined rotational position of the rotor the contact arms 62 will electrically couple a predetermined portion of the resistive material 76 between the output terminals 77*a,b* forming a potentiometer having a continuous variable resistance dependent upon rotor position and in which one output terminal and the wiper are commoned. In this embodiment, an external means, such as a knob, or even the slot 32 at the end of shaft 31 may be used as an indexing means for indicating or selectively positioning the rotor in a predetermined position within the arc of rotation of the rotor.

Figure 6:
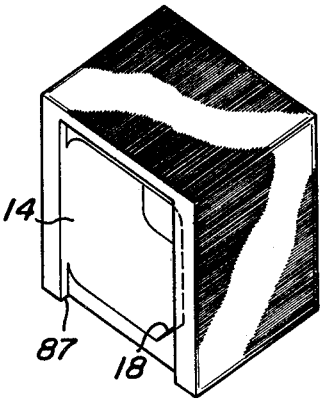
FIG. 6 is an oblique perspective of the base housing portion of the present invention showing one form of a recess at its lower end to accommodate the embodiment of the substrate in which the terminals extend laterally from the housing as shown in dotted lines in FIGS. 1 and 3.
Figure 3:
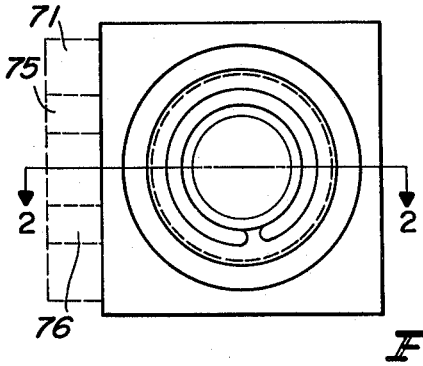
FIG. 3 is a plan view of the rotary switch of the present invention in solid lines and showing in dotted lines the alternative embodiment of the substrate shown in FIG. 1 having the output terminals extending laterally from the housing.

A still further alternative embodiment is shown in dotted lines in FIG. 1 and FIG. 3 and uses the housing illustrated in FIG. 6. Here it is seen that the substrate 71 is extended laterally past the housing (FIG. 3), the electrical paths 75 and 76 extending from the housing thereon for direct coupling to any exterior circuit means as desired. In this form of the invention, the lower end of housing 11, as shown in FIG. 6, is recessed having one side edge 87 open to accomodate the laterally extending portion of substrate 71 which is frictionally wedged within the recessed opening and held therein. To close the switch end, the housing and substrate is then typically dipped in an adhesive.

The process by which the circuit elements 75, 76, 83, 84, 85, and 86 are deposited on the substrate 71 is the well known process using thick film technology. For example, first the ceramic plate 71 is cut and is placed under a screen. Conductive material 75, 76, 76*a*, 76*b*, 76*c* is then pasted onto the ceramic. The composite is placed in an oven and baked. Then resistive elements 83, 84, 85 and 86 are screened onto position, baked and trimmed in a laser.

The electrical switch of the present invention is also provided with means for internally sealing the upper end of the switch to keep out contamination. This is accomplished by O-ring 90 (FIG. 2) which is positioned between the shaft 31 and an inside recessed end 92 of sleeve 12. The frictional drag between the shaft and O-ring 90 also serves to provide a "feel" to the operator upon rotating the shaft.

Further as shown in FIG. 2 the electrical switch of the present invention is adapted for mounting the housing 10 within an external encapsulated electrical component, such as an epoxy filled electronic regulator 93 shown in dotted lines in FIG. 2. When so positioned, an O-ring 94 is placed over the sleeve 12 to seal the recessed end 15 of base housing portion 11 preventing encapsulation material from entering the switch while simultaneously preventing said material from leaving the regulator along the sleeve 12. Nut 95 screws onto external threads 96 formed on the sleeve. Terminals 77 are shown coupled to a regulator printed circuit board 97 shown in dotted lines.

What has been described above is an electrical switch which has a variety of applications and is easy to assemble, simple to manufacture and is leakproof in its construction and use when assembled. Great flexibility is derived from the use of different substrates by which it is possible to integrate into a single rotary switch a variety of resistive or other electrical components which can be used in any low level electronic switching arrangement where discrete components are used in direct conjunction with a rotary switch. In its preferred form a five position rotary switch with internal resistance is used to select setting voltages at ambient temperatures of −20° to 225°F in thick film or discrete solid state voltage regulators in which the environment consists of an epoxy potting compound.

While the invention has been described in its preferred embodiments various other modifications and changes may be made to the present invention from the principles of the invention described above without departing from the spirit and scope thereof as encompassed in the accompanying claims. It is the intent to cover all such modifications and changes which are the equivalent of the disclosed invention.

We claim:

1. An electrical switch comprising a housing having a central aperture therethrough and having a shaped, recessed opening at one end, a thrust plate having a central aperture therethrough, and a shaped exterior cross section, the thrust plate being mounted within the recessed opening of the housing for limited axial movement therein, the shaped recessed opening of the housing and the shaped exterior cross section of the thrust plate cooperating to prevent rotational movement of the thrust plate relative to the housing, a rotor rotatably mounted within the housing having a shaft at one end extending outwardly of the switch through the central aperture of the housing and thrust plate and adapted for imparting rotational movement to the rotor, and an enlarged base at the other end, indexing means formed between the thrust plate and rotor base for positioning the rotor in a predetermined position within the arc of rotation of the rotor, means for axially biasing the indexing means into engagement, means securing the shaft to the housing, contact means secured to the base of the rotor for rotation therewith and electrically isolated therefrom, and an end plate secured to the recessed opening of the housing for closing the end thereof and having interior and exterior surfaces, electrical circuit elements mounted on the interior surface electrically isolated therefrom and terminating in a pair of output terminals extending outwardly of the housing, the electrical circuit elements being predeterminedly arranged in a geometric configuration having portions in alignment with the contact means for selectively being contacted by the contact means in relation to the selected rotational position of the rotor to complete the electrical circuit between the output terminals, the contacting means being of continuous conductive material for shunting non-selected portions of the circuit elements, whereby selected portions of the electrical circuit elements are electrically connected between the output terminals.

2. The electrical switch as claimed in claim 1 wherein the contact means includes a pair of contact arms, the electrical circuit elements include a first conductive material connected to one output terminal and having a portion forming a first continuous electrical path geometrically in alignment with the arc of rotation of one contact arm and in continuous electrical contact therewith, a second electrical path being formed between the other output terminal and another of the circuit elements, the second electrical path having a portion geometrically aligned with the arc of rotation of the other contact arm for contact therewith, the electrical circuit between the first continuous path and the second path being completed by the second contact arm contacting the aligned portion of the second path.

3. The electrical switch as claimed in claim 2 wherein the other of the circuit elements is a continuous resistive element geometrically aligned with the arc of rotation of the second contact arm and the switch is a potentiometer having a continuous variable resistance dependent upon rotor position.

4. The electrical switch as claimed in claim 2 wherein the second path comprises islands of the first conductive material separated from each other and being the portions geometrically aligned with the arc of rotation of the second contact arm for contact therewith, circuit means coupled between the other output terminal and each island to form the second electrical path, the indexing means positioning the rotor such that the second contact arm is in contact with a selected one of the islands, whereby the selected circuit elements corresponding to the index position of the rotor are those between the selected island and other output terminal.

5. The electrical switch as claimed in claim 4 wherein the circuit means includes a plurality of resistive elements of a second material having predetermined resistances, a single resistive element bridging two adjacent ones of the islands, adjacent ones of the elements being coupled together by the interposed island to form the second electrical path.

6. The electrical switch as claimed in claim 1 wherein the thrust plate has recess means of predetermined circumferential length relative to the longitudinal axis of the switch, each end of the recess means forming a stop shoulder, the rotor has lug means, the lug means of the rotor being received within the recess means of the thrust plate, the lug means abutting the shoulder at the respective ends of the recess means to limit rotational movement of the rotor to a predetermined arc.

7. The electrical switch as claimed in claim 5 wherein the end plate is made of plastic, the circuit elements are affixed thereto having outward surfaces exposed and the end plate further comprises closure means frictionally wedged in the recessed opening of the housing receiving the end plate, the two terminals extending through the closure means.

8. The electrical switch as claimed in claim 5 wherein the end plate is made of a ceramic material the circuit elements are affixed thereto having their upper surfaces exposed, the end plate being affixed to the housing by an adhesive, a portion of the end plate extending laterally from the housing, the output terminals being formed on the laterally extending portion.

9. The electrical circuit as claimed in claim 1 wherein the shaped recess opening of the housing and the shaped exterior cross-section of the thrust plate is square, the enlarged base of the rotor is round, the recessed opening of the housing is formed with a second square recess at its outer end, and the end plate is formed as a square of a dimension to fit within and be frictionally held by the second recess of the housing.

10. The electrical switch as claimed in claim 6 wherein the recess means of the thrust plate are a pair of oppositely disposed circular recesses, each end of each circular recess forming a stop shoulder, and the lug means comprises a pair of oppositely disposed lugs mounted adjacent the enlarged base of the rotor, each lug being received in one of the circular recesses of the thrust plate and limiting rotational movement of the rotor.

11. The electrical switch as claimed in claim 6 wherein the indexing means comprises a pair of oppositely disposed detents extending toward the recessed opening of the housing, and a plurality of oppositely disposed notches formed on the enlarged base of the rotor facing the other end of the housing, and the biasing means positioned between the housing and the thrust plate for biasing the detents of the thrust plate toward the notches in the base, rotational movement imparted to the shaft moving the notches of the base relative to the detents of the thrust plate to position the rotor in the selected position, the thrust plate reciprocating axially as the detents are forced out of one pair of notches into the next pair of adjacent notches.

12. The electrical switch as claimed in claim 11 wherein the biasing means is a wave washer mounted concentric with the shaft and is mounted in the recessed opening of the housing between the thrust plate and the inward end of the recessed opening of the housing.

13. The electrical switch as claimed in claim 12 wherein the contact means is a spring contact having a shaped central portion and two extending arm portions, the end of the base member facing the recessed open end of the housing having a shaped recess therein, the shaped central portion of the spring contact being received within the recess of the base.

14. The electrical switch as claimed in claim 1 further comprising means within the housing for sealing the one end of the switch.

15. The electrical switch as claimed in claim 14 wherein the means comprises an O-ring concentrically mounted on the shaft adjacent the one end and frictionally held between the housing and the shaft to provide a frictional drag to the rotation of the shaft.

16. The electrical switch as claimed in claim 1 wherein the housing comprises a base housing portion having the recessed opening at the one end and a second recessed opening at the other end and a central aperture therethrough, and a sleeve portion having a central aperture therethrough and a flange portion at one end received within the second recessed open end of the base housing and a cylindrical extending portion received within the central bore of the base housing, the cylindrical extending portion being turned over and secured to the base housing, the second recessed end of the base housing and the flange portion of the sleeve being of matching shapes to prevent rotation of the one relative to the other when the shaft is rotated, the outwardly extending shaft extending through the central aperture of the base housing and sleeve.

17. The electrical switch as claimed in claim 16 wherein the rotor, the base housing portion and the thrust plate are plastic.

18. The electrical switch as claimed in claim 14 further comprising a second external housing, an encapsulated electrical component within the external housing, means on the first housing for mounting the first housing within the second housing, the rotor shaft accessible from the exterior of the second housing, the terminals electrically coupled to the encapsulated electrical component, and sealing means mounted between the first housing and the second housing for preventing escape of the encapsulation material from the second housing and for preventing ingress of the encapsulation material into the first housing.

* * * * *